United States Patent [19]

Parsons

[11] Patent Number: 4,898,130

[45] Date of Patent: Feb. 6, 1990

[54] VALVE MECHANISMS

[75] Inventor: Bryan N. V. Parsons, Stoney Stanton, United Kingdom

[73] Assignee: Jaguar Cars Limited, United Kingdom

[21] Appl. No.: 347,740

[22] Filed: May 5, 1989

Related U.S. Application Data

[63] Continuation of Ser. No. 252,168, Sep. 30, 1988, abandoned.

[30] Foreign Application Priority Data

Oct. 3, 1987 [GB] United Kingdom ..... 8723256

[51] Int. Cl.[4] ..... F01L 1/30

[52] U.S. Cl. ..... 123/90.16; 123/90.2; 123/90.39; 251/238

[58] Field of Search ..... 251/238; 123/90.16, 123/90.2, 90.39, 90.61

[56] References Cited

U.S. PATENT DOCUMENTS

| | | | |
|---|---|---|---|
| 1,107,963 | 8/1914 | Kind | 251/238 |
| 2,773,490 | 12/1956 | Miller | 123/90.16 X |
| 2,878,796 | 3/1959 | Mannerstedt | 123/90.61 X |
| 2,954,017 | 9/1960 | Forstner | 123/90.16 |
| 3,138,038 | 6/1964 | Scherenberg et al. | 123/90.16 X |
| 3,911,879 | 10/1975 | Altmann | 123/90.16 |
| 4,475,496 | 10/1984 | Sugahara | 123/90.16 X |
| 4,572,118 | 2/1986 | Baguena | 123/90.16 |
| 4,633,900 | 1/1987 | Suzuki | 251/238 |

FOREIGN PATENT DOCUMENTS

| | | | |
|---|---|---|---|
| 447028 | 11/1924 | Fed. Rep. of Germany . | |
| 2335632 | 1/1975 | Fed. Rep. of Germany | 123/90.16 |
| 1836 | of 1913 | United Kingdom . | |
| 220088 | 8/1924 | United Kingdom | 123/90.16 |
| 520733 | 10/1938 | United Kingdom . | |

*Primary Examiner*—John Rivell

*Attorney, Agent, or Firm*—Davis, Bujold & Streck

[57] ABSTRACT

A valve mechanism includes a poppet type valve, a valve lever pivotally mounted at one end and attached at the other end to the end of the stem of the valve, the valve lever defines a track in which is located a drive pin and a drive mechanism is arranged to drive the drive pin in oscillatory manner; the track has a first portion which, when the valve is closed is engaged by the drive pin and coincides with the path of the drive pin, and a second portion which diverges from the path of the drive pin so that when engaged by the drive pin movement of the drive pin will cause the valve lever to move, opening and closing the valve. Preferably the mean position of oscillation of the drive pin is adjustable so that the duration and amplitude of valve opening may be varied.

21 Claims, 5 Drawing Sheets

VALVE MECHANISMS

This is a continuation of co-pending application Ser. No. 252,168 filed on Sept. 30, 1988 now abandoned.

BACKGROUND OF THE INVENTION

The present invention relates to valve mechanisms and in particular, although not exclusively, to valve mechanisms for internal combustion engines.

SUMMARY OF THE INVENTION

According to one aspect of the present invention a valve mechanism comprises a valve having a valve stem which is located for axial movement in a valve guide and a valve head adapted at one extreme of movement of the valve to locate against and close a valve seat; a valve lever pivotally mounted at one end and attached adjacent the other end to the end of the valve stem remote from the valve head; said valve lever defining a track; a drive pin engaging in said track and drive means to drive said drive pin in oscillatory manner; said track having a first portion which, when the valve is closed, is engaged by the drive pin and coincides with the path of the drive pin and a second portion which diverges from the path of the drive pin, so that engagement of the second portion by the drive pin will cause the valve lever to move opening and closing the valve.

The mechanism described above provides desmodromic action, the valve lever controlling movement of the valve in both directions. There is consequently no need for the return springs used in conventional poppet valve mechanisms and the inherent disadvantages of such mechanisms, in particular valve bounce, are avoided and the mechanism may consequently be run at faster speeds.

With this mechanism, the duration and amplitude of the valve opening depends upon the portion of the track engaged by the drive pin as it oscillates, this may be adjusted by varying the mean position of oscillation of the drive pin.

BRIEF DESCRIPTION OF THE DRAWINGS

Various embodiments of the invention are now described, by way of example only, with reference to the accompanying drawings, in which.

DESCRIPTION OF A PREFERRED EMBODIMENT

Figure 1:
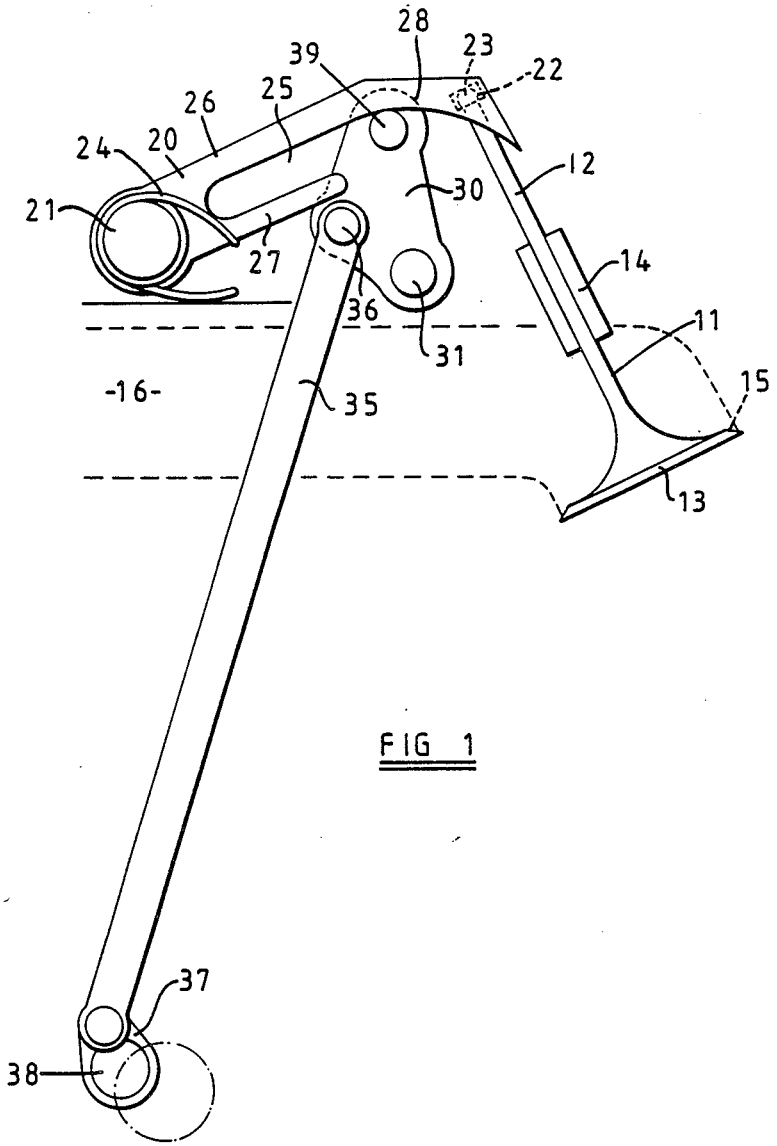
FIG. 1 is a diagrammatic illustration of a valve mechanism in accordance with the present invention.

The valve mechanism illustrated in FIG. 1 comprises a poppet valve 11 with valve stem 12 and valve head 13. The valve stem 12 is slidingly located in a valve guide 14 and the valve head 13 is arranged to engage against a valve seat 15, to close port 16.

A valve lever 20 is mounted adjacent one end, on pivot 21. A ball formation 22 on the end of valve stem 12 engages in a cylindrical hole 23 in the end of valve lever 20 remote from pivot 21, so as to permit limited pivotal and axial movement between the valve stem 12 and valve lever 20. A light torsion spring 24 acts on the valve lever 20 to take up the limited axial movement between lever 20 and valve stem 12 and ensure that the valve 11 is seated when in the closed position.

A track 25 is provided on the valve lever 20, the lever 20 being bifucated with upper and lower limbs 26 and 27 which define a straight portion of the track 25. The upper limb 26 is extended, the lower edge of the extended portion defining a circular portion 28 of track 25.

An intermediate lever 30 is mounted on pivot 31, the axis of which coincides with the centre of curvature of the circular portion 28 of track 25, when the valve 11 is seated. A drive link 35 is connected at one end to an intermediate lever 30, by means of pivot 36 which is spaced from the pivot 31, and at the other end to a crank 37 on drive shaft 38. A drive pin 39 is provided on the intermediate lever 30, so that it engages the track 25 in valve lever 20.

Figure 2A:
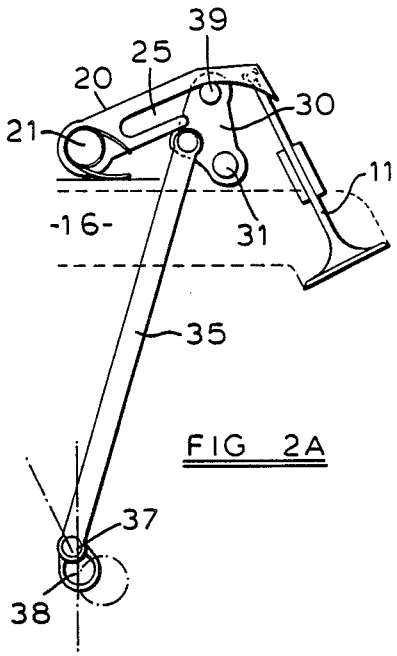
FIGS. 2A to 2D illustrate the sequential operation of the valve mechanism illustrated in FIG. 1.
Figure 2B:
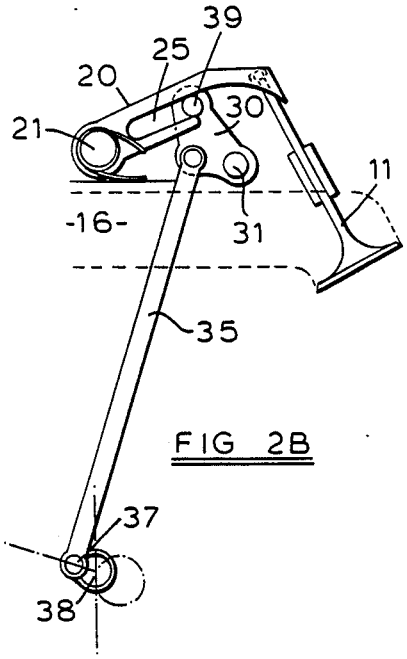
Figure 2C:
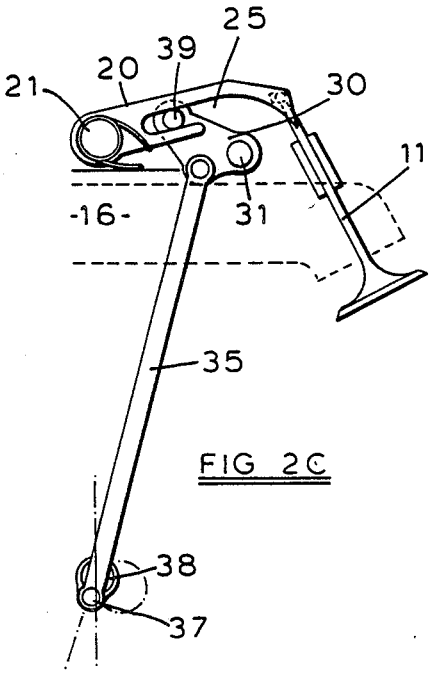
Figure 2D:
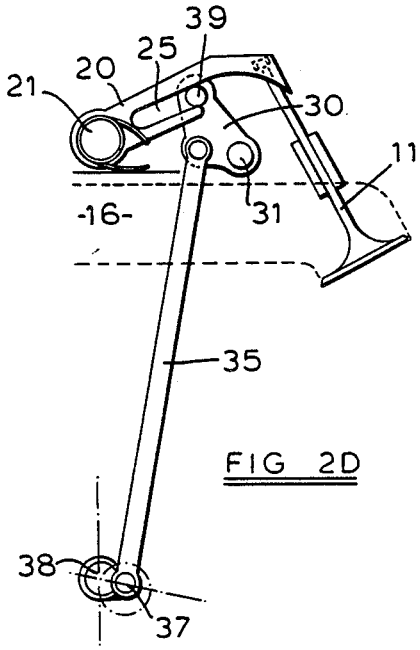

The drive shaft 38 is driven from the main crank shaft of the engine via gearing which will give it 2:1 reduction. When the drive shaft 38 is rotated, the motion of the crank 37 is transitted by drive link 35, which causes the intermediate lever 30 to oscillate about pivot 31, and drive pin 39 to move forwards and backwards along track 25. Starting from a position illustrated in FIG. 2A, the drive pin 39 will initially move round the circular portion 28 of track 25, the drive pin 39 moving about the same axis as the centre of curvature of the circular portion 28, the valve lever 20 remaining in the position illustrated and the valve 11 remaining closed. This continues until the drive pin 39 engages the lower limb 27 defining the straight portion of the track 25, as indicated in FIG. 2B, whereafter further movement of the intermediate lever 30 will cause downward movement of the valve lever 20, thus opening valve 11. This continues until the position illustrated in FIG. 2C where the valve will be fully opened. Continued rotation of the drive shaft 38 will then cause drive pin 39 to engage the straight portion of limb 26 of lever 20, thus pivotting valve lever 20 upwardly until at the end of the straight portion of limb 26, the valve 11 will be closed as illustrated in FIG. 2D. The drive pin 39 will then continue to slide against the circular surface of limb 26 the valve remaining shut, until it again reaches the position illustrated in FIG. 2B.

With the valve mechanism described above, the valve timing and lift are fixed. This is acceptable for operation of the exhaust valves of an engine and, as a compromise, for inlet valves. However, modern high performance internal combustion engines have been developed to give maximum power and output at high engine speeds. In order to achieve this, the valve mechanism is required to give high lift with long duration to encourage gas flow at high speeds. In such high performance engines, the gas flow at low engine speeds is very much compromised. Under such conditions, incoming air is spilled back into the manifold due to late closing of the inlet valve, producing a corresponding reduction in torque output available at low speeds. Also, the exhaust gas is released too early, reducing the expansion ratio of the engine and hence its efficiency. Furthermore, the overlap period where both inlet and exhaust valves are open is too large and allows free flow of air and fuel through the exhaust valve, thus causing emission problems.

The lift and timing of the valve mechanism described above depends on the portion of the track 25 that is engaged by the drive pin 39. This may be adjusted by adjusting the position of the drive shaft 38, as illustrated in FIGS. 3 and 4.

Figure 3:
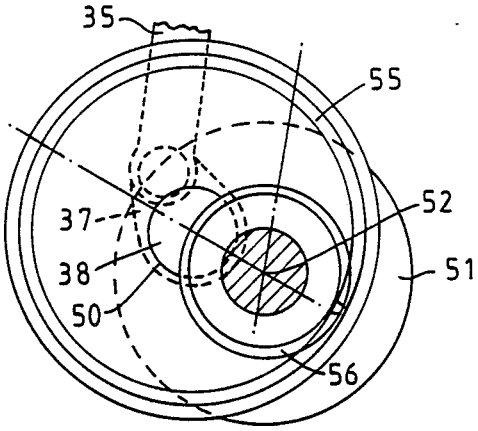
FIG. 3 illustrates the means of mounting the drive shaft of the valve mechanism illustrated in FIG. 1 to provide a variable valve mechanism.
Figure 4:
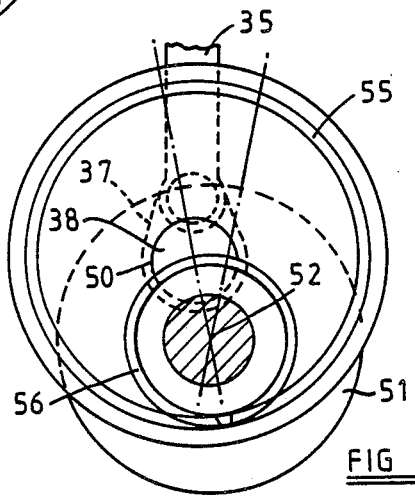
FIG. 4 shows an alternative position of the drive shaft of the mechanism illustrated in FIG. 3.

As illustrated in FIGS. 3 and 4, the drive shaft 38 is mounted for rotation in the bearing 50, which is in turn mounted eccentrically of a support disc 51. The support disc 51 is mounted within the engine block in suitable bearings, so that it may be rotated about its centre 52, and means (not shown) is provided for rotation of the disc 51. As the shaft 38 is mounted eccentrically of disc 51, rotation of the disc 51 will alter the separation between the shaft 38 and the pivot 31 of intermediate lever 30 and hence the portion of track 25 which is engaged by drive pin 39.

An internal gear 55 is mounted on the drive shaft 38 and this meshes with gear 56 which is drivingly connected to the crank shaft of the engine in suitable manner. The gear 56 is half the diameter of the internal gear 66, so as to provide a 2:1 reduction in driven, and is mounted coaxially of the disc 51, so that as the disc 51 is rotated or vary the position of shaft 38, the gears 55 and 56 will remain in mesh.

As the disk 51 is rotated to vary the position of the shaft 38, relative movement of gears 55 and 56 will also cause shaft 38 to rotate and as a result, in addition to varying the lift and duration of opening of the valve, the above mechanism will also vary the position of maximum opening relative to the position of the crank shaft of the engine.

The position of the drive arrangement illustrated in FIG. 3 corresponds to the position of the valve mechanism illustrated in FIG. 1 and as the drive shaft 38 is rotated by means of gears 55 and 56, the valve mechanism will operate as described above with reference to FIGS. 2A to 2D. In this set up, the control angle, that is the angle subtended between the line connecting the centre of pivot 31 and the centre of disc 51 and the line connecting the centre of disc 51 and the axis of shaft 38 is 80°. At low engine speeds, disc 51 may be rotated so that the control angle is reduced to say 20°, as illustrated in FIG. 4.

Figure 5A:
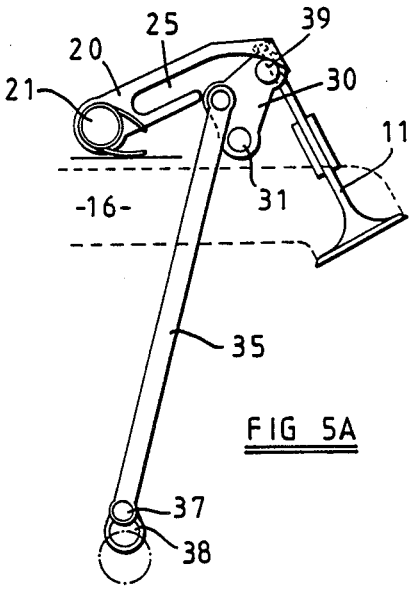
FIGS. 5A to 5D illustrate the sequential operation of the valve mechanism with a drive shaft in the position illustrated in FIG. 4.
Figure 5B:
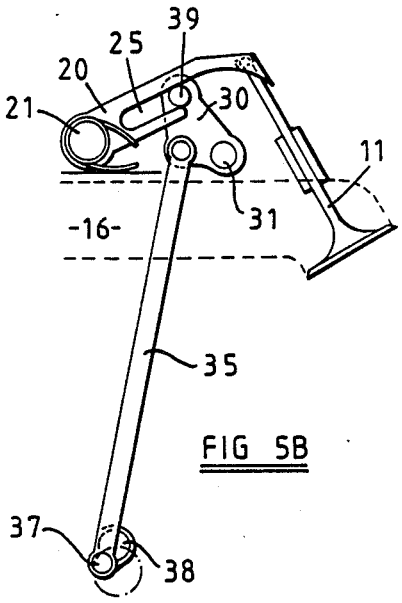
Figure 5C:
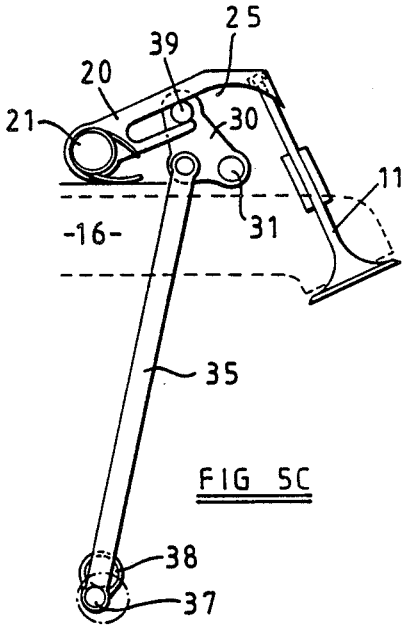
Figure 5D:
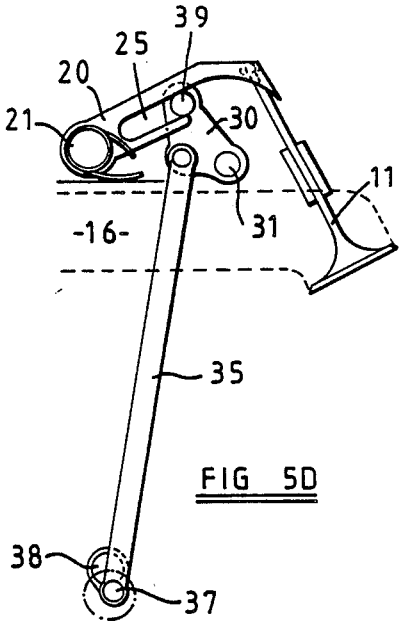

With the control angle at 20°, upon rotation of shaft 38, the valve mechanism will effect the sequential operation illustrated in FIGS. 5A to 5D. As illustrated in the FIGS. 5A to 5D, the angular displacement of shaft 38 and hence the crank shaft, over which the valve 11 is open, that is between the positions illustrated in FIGS. 5B to 5D, is very much reduced, as is the maximum lift of the valve 11 as illustrated in FIG. 5C.

Figure 6:
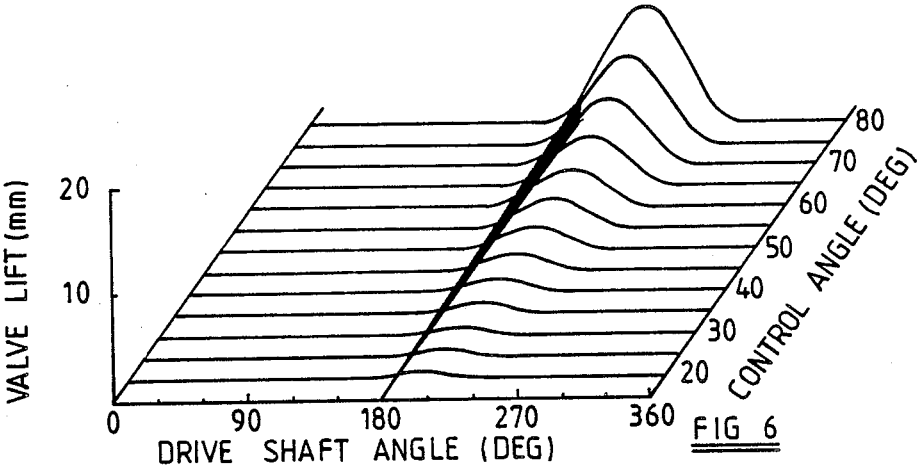
FIG. 6 is a plot of valve lift against drive shaft angle for varying control angles for a typical variable valve mechanism as illustrated in FIGS. 3 to 5.

The means for rotating disc 51 may be controlled in accordance with, for example engine speed, to give a progressive increase in the control angle as the engine speed increases. As illustrated in FIG. 6, this will produce a progressive increase in duration of valve opening when measured in degrees of rotation of the drive shaft, and valve lift and will also produce an advance in the point at which the maximum valve opening occurs. Operation of the valve mechanism can consequently be matched to the engine requirements over a wide range of engine speeds. Rotation of the disc 51 may alternatively be used to control the power output of the engine by controlling the inlet valve to vary the amount of air or air/fuel mixture which is drawn into the engine. The means for rotation of disc 51 may consequently be controlled by the throttle mechanism or some other engine management system.

In multi-valve arrangements a plurality of valves may be driven by a common drive shaft 38, cranks 37 being provided for each valve, in appropriate phase relationship. With a variable valve arrangement, the common drive shaft 38 may be supported at axially spaced locations by a series of support discs, these support discs being interconnected for adjustment purposes.

Figure 7:
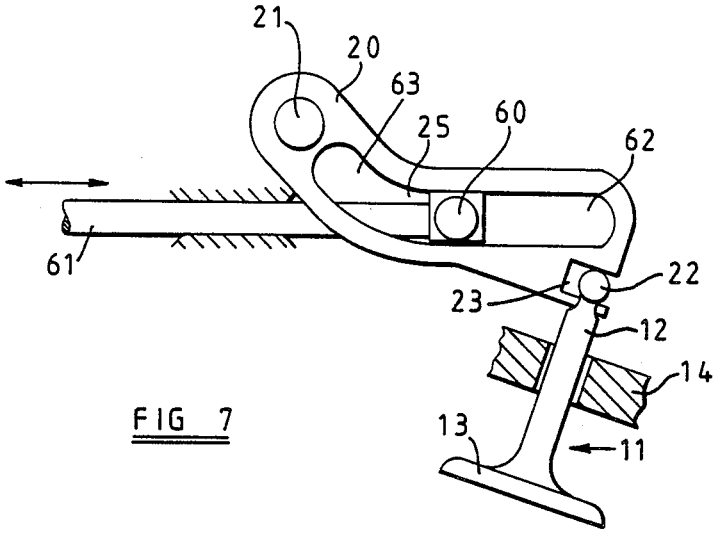
FIG. 7 illustrates an alternative valve mechanism in accordance with the present invention.

In the embodiment illustrated in FIG. 7, the drive pin 60 is driven in linear reciprocating manner by means of rod 61. The track 25 in valve lever 20 has a straight portion 62 towards the end of the lever 20 which engages the valve 11, this straight portion being aligned with the path of drive pin 60 when the valve 11 is closed; and a curved portion 63 towards the pivot 21 end of lever 20, which when engaged by the drive pin 60 will cause the lever 20 to pivot, opening the valve 11.

The rod 60 may be driven in any suitable manner which will provide positive drive in both directions, for example a crank and connecting rod or Scotch yoke mechanism. The mean position of oscillation of drive pin 60 may also be varied by suitable means, for example by variation of the position of the drive shaft in similar manner to that described with reference to FIG. 1 or variation of the length of rod 61.

Figure 8:
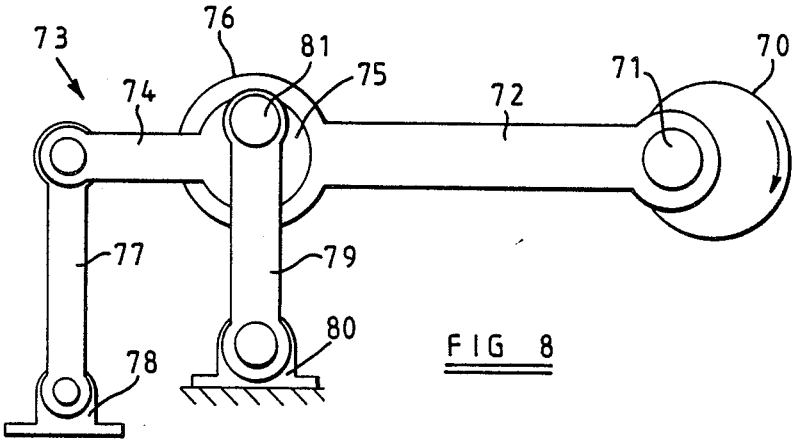
FIG. 8 illustrates an alternative drive mechanism for the valve mechanism illustrated in FIG. 1.

The drive mechanism illustrated in FIG. 8 comprises a drive shaft 70 with crank 71. The crank 71 is connected to a parallelogram linkage 73 by means of link 72, one end of the link 72 engaging the crank 71 and the other end being pivotally connected to one link 74 of the parallelogram linkage 73, a large diameter journal 75 extending laterally from one end of the link 74 and engaging a bearing 76 at the end of link 72. The other end of link 74 is pivotally connected to link 77 and the other end of link 77 is pivotally connected to a movable mount 78. A further link 79 which is equal in length and parallel to link 77 is pivotally connected at one end to a fixed mount 80 and at the other end to link 74 eccentrically of the journal 75, by means of a drive pin 81. With the drive mechanism described above, as the drive shaft 70 rotates, the crank 71 will cause drive pin 81 to oscillate over an arcuate path controlled by link 79. The mean position of oscillation of the drive pin 81 may be varied by moving mount 78, thereby rotating link 74 and the journal 75 so that the position of drive pin 81 relative to the axis of drive shaft 70 is adjusted.

The drive pin 81 may engage directly in the track 25 of valve lever 20 or may be connected thereto by a drive link 35 and intermediate lever 30 similar to those illustrated in FIG. 1. Alternatively, the drive pin 81 may be connected via a connecting rod to the rod 61 of the valve mechanism illustrated in FIG. 7.

Various modifications may be made without departing from the invention. For example, it will be appreciated that while in the embodiment illustrated in FIG. 1, the drive shaft is positioned in the lower part of the engine, the drive shaft with suitable drive linkage may alternatively be positioned in the head portion of the engine.

I claim:

1. A valve mechanism comprising; a valve having a valve stem which is located for axial movement in a valve guide and a valve head adapted at one extreme of movement of the valve to locate against and close a valve seat; a valve lever pivotally mounted at one end and attached adjacent the other end to the end of the valve stem remote from the valve head; said valve lever defining a track; a drive pin permanently engaging said track and drive means to drive said drive pin in oscillatory manner; said track having a first portion which, when the valve is closed, is engaged by the drive pin and coincides with the path of the drive pin and a second portion which diverges from the path of the drive pin, so that engagement of the second portion by the drive pin will cause the valve lever to move to positively open and close the valve.

2. A valve mechanism according to claim 1 in which the drive pin oscillates in an arcuate path.

3. A valve mechanism according to claim 2 in which the drive pin is provided on an intermediate lever, said intermediate lever being pivotally mounted for rotation about an axis parallel to the axis of rotation of the valve lever; a drive link is pivotally connected at one end to the intermediate lever and at the other end to a crank on a drive shaft, so that upon rotation of the drive shaft the intermediate lever and drive pin thereon will oscillate about its pivot; the first portion of the track on the valve lever being arcuate having a radius equal to the separation between the pivot of the intermediate lever and the drive pin thereon.

4. A valve mechanism according to claim 3 in which the second portion of the track is straight.

5. A valve mechanism according to claim 4 in which the valve lever is bifurcated having parallel limbs which define therebetween the straight second portion of the track, the upper limb being extended, the lower edge of the extended portion defining the circular first portion of the track.

6. A valve mechanism according to claim 1 in which the drive pin in driven in linear reciprocating manner.

7. A valve mechanism according to claim 6 in which the first portion of the track is disposed towards the end of the valve lever connected to the valve stem and is straight while the second portion of the track is curved.

8. A valve mechanism according to claim 1 in which means is provided for varying the mean position of oscillation of the drive pin.

9. A valve mechanism according to claim 8 in which the drive pin is driven by a crank on a drive shaft via an intermediate pivotted lever, means being provided for varying the separation between the axis of the drive shaft and the pivotal axis of the intermediate lever.

10. A valve mechanism according to claim 9 in which the drive shaft is mounted in a bearing formed eccentrically of a support disc, the disc being rotatably supported such that upon rotation of the disc, separation between the axis of the drive shaft and the pivotal axis of the intermediate lever will be adjusted, means being provided for rotation of the support disc.

11. A valve mechanism according to claim 10 in which an internal gear mounted on the drive shaft meshes with a drive gear, the axis of rotation of the drive gear coinciding with the centre of the support disc.

12. A valve mechanism according to claim 11 in which the drive gear is half the diameter of the internal gear.

13. A valve mechanism according to claim 9 in which means is provided for varying the distance between the axis of the drive shaft and the drive pin.

14. A valve mechanism according to claim 13 in which the drive pin is mounted eccentrically on a journal pivotally mounted on an intermediate lever, means being provided for rotation of the journal to vary the separation between the axis of the drive shaft and drive pin.

15. A valve mechanism according to claim 8 in which the means for varying the mean position of oscillation of the drive pin is controlled as a function of the engine speed.

16. A valve mechanism according to claim 8 in which the means for varying the mean position of oscillation of the drive pin is controlled to control the power output of the engine.

17. A valve mechanism according to claim 1 in which the valve stem is attached to the valve lever in a manner which will permit limited pivotal and axial movement therebetween.

18. A valve mechanism according to claim 17 in which a ball on the end of the valve stem engages in a cylindrical hole in the end of the valve lever.

19. A valve mechanism according to claim 17 in which resilient means acts on the valve lever in order to ensure that the valve is seated when in its closed position.

20. A multi-valve assembly comprising a plurality of valve mechanisms as claimed in claim 1, the valve mechanisms having a common drive shaft, each mechanism being driven by a crank on the drive shaft, the cranks being arranged in appropriate phase relationship.

21. A multi-valve assembly according to claim 20 in which the common drive shaft is supported eccentrically at axially spaced locations by a plurality of support discs, the support discs being interconnected for adjustment purposes.

* * * * *